US007302764B2

(12) United States Patent
Harris et al.

(10) Patent No.: US 7,302,764 B2
(45) Date of Patent: Dec. 4, 2007

(54) BOOT FOR APPLYING MEDICINES

(76) Inventors: Bossiz Harris, P.O. Box 425, Waynesville, MO (US) 65583; Joyce K. Harris, P.O. Box 425, Waynesville, MO (US) 65583

( * ) Notice: Subject to any disclaimer, the term of this patent is extended or adjusted under 35 U.S.C. 154(b) by 405 days.

(21) Appl. No.: 10/978,064

(22) Filed: Oct. 30, 2004

(65) Prior Publication Data

US 2005/0091880 A1 May 5, 2005

Related U.S. Application Data

(60) Provisional application No. 60/516,506, filed on Oct. 31, 2003.

(51) Int. Cl.
*A43B 7/02* (2006.01)

(52) U.S. Cl. ..... 36/2.6; 36/140

(58) Field of Classification Search ..... 36/2.6, 36/140

See application file for complete search history.

(56) References Cited

U.S. PATENT DOCUMENTS 2,298,299 A * 10/1942 Joy et al. ..... 36/2.6
2,565,751 A * 8/1951 Birkle ..... 604/293
2,633,846 A * 4/1953 Wray ..... 604/23
3,478,738 A * 11/1969 Cox et al. ..... 601/166
3,977,093 A * 8/1976 Santroch ..... 36/2.6
4,080,971 A * 3/1978 Leeper ..... 607/111
5,623,772 A * 4/1997 Sunderland et al. ..... 36/2.6
5,956,866 A * 9/1999 Spears ..... 36/2.6
6,185,845 B1 * 2/2001 Gordon ..... 36/7.1 R
6,981,339 B2 * 1/2006 Szczesuil et al. ..... 36/2.6
7,013,579 B2 * 3/2006 Szczesuil et al. ..... 36/2.6
2002/0133973 A1 * 9/2002 Lin ..... 36/2.6

* cited by examiner

*Primary Examiner*—Marie Patterson

(57) ABSTRACT

The present invention provides a boot for applying medicine to a foot for a variety of conditions. Wearing the boot allows one to perform job and domestic duties while treating a foot. The present invention has a sole beneath an upper with a waterproof interior. The sole has a generally foot shape in a variety of sizes. Additionally, the sole incorporates heating discs and appurtenant wiring. The wiring exits the sole and runs to a switch and a box containing batteries. To use the boot, a person places fluids, or water, and medicine into the boot. The person then inserts a foot into the boot and turns on the heating discs which then heat the sole and the fluids to a comfortable temperature.

4 Claims, 3 Drawing Sheets

BOOT FOR APPLYING MEDICINES

CROSS REFERENCE TO RELATED APPLICATION

This non-provisional patent application claims priority to the provisional application for patent having Ser. No. 60/516,506, which was filed on Oct. 31, 2003 and to the provisional application for patent having Ser. No. 60/506,406, which was filed on Nov. 3, 2003.

BACKGROUND OF THE INVENTION

For people, the feet endure much abuse in a lifetime. The feet bear the weight of a person and absorb the impact from walking, running, or moving. Feet also remain within socks and shoes for many hours of the day. When in socks and shoes, feet sweat and produce unhealthy conditions. Feet sometimes develop odors, fungi such as athlete's foot or jungle rot, ingrown toe nails, dry skin, and cracked skin, among other conditions. Those afflicted with diabetes also develop foot conditions requiring medicinal treatment.

When a person's feet exhibit one or more of these conditions, podiatrists and physicians recommend soaking feet in a medicinal solution. People often use a foot bath or other tub to soak their feet. During a soak, a person sits in a chair for a treatment. People also appreciate a warm soak for their sore feet. If a prescription calls for treatments many times a day, a person falls behind on the job. Fearing adverse actions about a job, a person may overlook treating their feet. Skipped treatments slow the healing of feet or worse the feet may deteriorate. Further, weakened feet may incapacitate a person for a lengthy period, longer than if treatment had been followed.

DESCRIPTION OF THE PRIOR ART

As people's feet have hurt for years due to various causes, the prior art contains many devices to improve foot comfort. The devices address mechanical issues such as heel pain from when the foot strikes the ground during walking and foot soreness from excessive standing. Devices to relieve foot pain are known in the prior art.

The patent to Tsai, No. 5,175,946, shows an insole with a pneumatic buffer in the heel. Like the present invention, the insole alleviates foot pain, from heel strike. However unlike the present invention, this patent has an insole inserted into a shoe, air chambers to absorb impact, no heating capacity, and no capacity to contain liquids. This patented insole cushions the heel specifically while the present invention contains liquid medicine surrounding a foot.

The patent to Grim et al., No. 5,378,223, shows a conforming support pad for orthopedic uses. As in the present invention, the patented pad supports a foot particularly the sole and permits application of salves and ointments to the sole. In contrast to the present invention, the patented pad conforms to the shape of a foot with a bladder to establish the shape of the pad, and a filler to retain stiffness in the pad. This patented pad conforms to and supports an injured foot while the present invention bathes a foot in liquid medicine.

And, the patent to Reilly, No. 5,836,899, discloses a vibrating massage system for shoes. Similar to the present invention, the patented system has vibrating discs located in the sole of a shoe, batteries and controls upon the shoe tongue, and a zipper on the tongue. Contrary to the present invention, the patented system does not contain fluids around a foot and lacks heating capability. This patented system massages the sole of a foot while the present invention medicates a foot with a heated liquid.

The present invention improves the application of medicine to feet so a person can walk while treating their feet.

SUMMARY OF THE INVENTION

The present invention relates to footwear in general and a therapeutic boot in particular.

The present invention allows a person to wear a boot filled with a medicinal solution. Donning a solution filled boot allows a person to perform job and domestic duties while treating a foot. The present invention has an upper upon a sole with a waterproof interior for the upper. The upper has a boot like shape with a zipper upon the front surface for ready donning of the boot. The sole has a generally foot shape in a variety of sizes. Additionally, the sole incorporates heating discs and appurtenant wiring. The wiring exits the sole and runs up the back of the boot to a switch and box containing batteries. To use the boot, a person places a measured quantity of water, medicine, ointment and the like into the interior of the boot. The person then inserts a foot into the boot. For comfort, a person turns on the heating discs which then heat the sole and the fluids placed within the boot.

There has thus been outlined, rather broadly, the more important features of the invention in order that the detailed description thereof that follows may be better understood and that the present contribution to the art may be better appreciated. The present invention incorporates alternate features such as more sizes and widths to accommodate more consumers, a disposable insert to contain a medicinal solution and to remove easily from the boot, and variations in color and texture of the boot to enhance aesthetic appeal. The disposable insert feature allows a person to remove the insert, containing the solution, from the boot and thus clean the boot. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved boot for applying medicines.

Another object is to provide such a boot for applying medicines that has a low cost of manufacture with regard to both materials and labor, and which accordingly is then susceptible of low prices of sale, thereby making such a boot economically available to the medical industry.

Another object of the present invention is to provide a boot for applying medicines that provides some of the advantages from the apparatuses and methods of the prior art, while simultaneously overcoming some of the disadvantages normally associated therewith.

Another object of the present invention is to provide a boot for applying medicines with a waterproof inner layer. This makes it possible to dispense liquid medicines and medicines dissolved in liquids around a foot.

Another object of the present invention is to provide a boot for applying medicines with a heating system. This makes it possible to warm liquid medicines safely near a foot.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
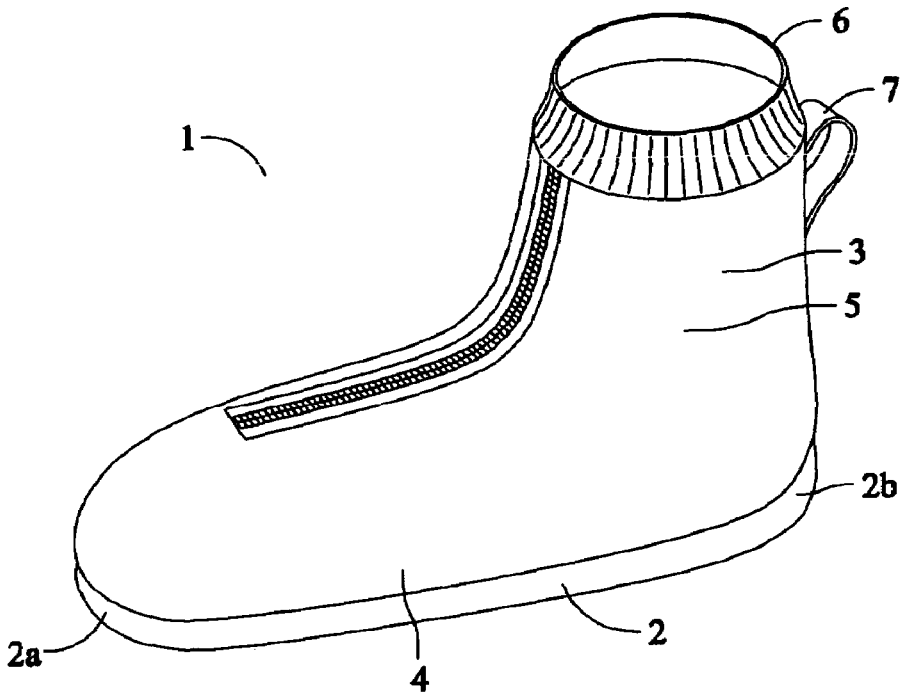
FIG. 1 shows an isometric view of the preferred embodiment of the boot for applying medicines constructed in accordance with the principles of the present invention.

The present invention overcomes the prior art limitations by providing a waterproof boot with heating. The present invention 1 is described in FIG. 1 as a boot 1 with a sole 2 in a variety of sizes. The sole 2 has a toe 2*a* and an opposite heel 2*b*. Upon the sole 2, an upper 3 attaches. The upper 3 has a base 4 of similar shape to the sole 2 and an extension 5 to cover the ankle area and slightly above an ankle. At the top of the extension 5 and towards the rear of the boot 1, a means to pull the extension 5, or loop 7, attaches to the extension 5. The loop 7 assists a person in donning the boot 1. Above the loop 7, the boot 1 has a cuff 6 that firmly seals against the leg to minimize leakage of medicinal liquid from the interior of the boot 1. The cuff 6 retains liquid in the boot 1 as a wearer sits, stands, and walks through daily activities. In an alternate embodiment, the present invention 1 has a zipper upon the instep of the boot 1 and upwards into the extension 5. Opening of the zipper eases placement of the boot 1 upon a foot. The zipper has flaps and the like to seal the zipper area and prevent leakage. A person dons the present invention 1 as with a regular boot 1.

Figure 2:
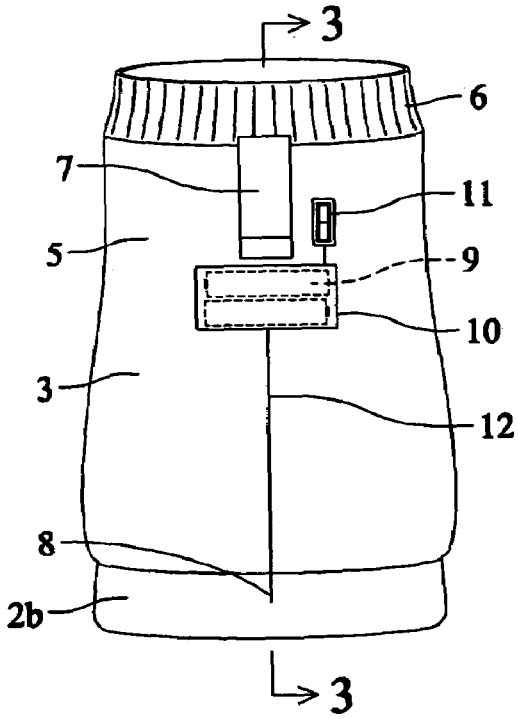
FIG. 2 shows a view of the heel of the preferred embodiment of the boot for applying medicines.

Rotating the boot 1, FIG. 2 shows the rear of the boot 1 from the heel 2*b* to the cuff 6. As in FIG. 1, the upper 3 attaches to the sole 2, here shown at the heel 2*b* 2*b*. The upper 3 has an extension 5 above the heel 2*b* that reaches above the ankle in height. The extension 5 has a generally cylindrical shape of sufficient diameter to admit an ankle corresponding to the boot size. Where the cuff 6 attaches to the upper 3, a loop 7 joins the extension 5 above the heel 2*b*. Between the heel 2*b* and the loop 7, wiring 12 runs to a box 10 containing batteries 9 and a switch 11 controls the release of power from the box 10 to the wiring 12. Opposite the switch 11, the wiring 12 runs into and through the sole 2 to deliver power for heating of the boot 1 and medicinal liquid within it.

Figure 3:
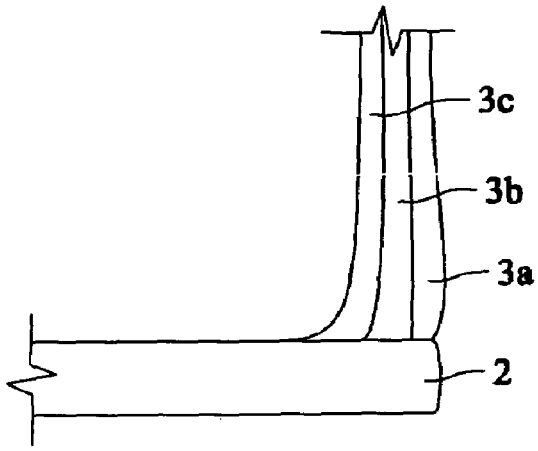
FIG. 3 shows a partial sectional view of the preferred embodiment of the boot for applying medicines.

Taking a section through the boot 1, FIG. 3 shows the construction of the boot 1. The boot 1 begins with a sole 2 of material suitable to withstand the demands of walking. Upon the perimeter of the sole 2, an outer layer 3*a* extends upwardly from the sole 2 and opposite of the surface in contact with the ground. The outer layer 3*a* forms the boot 1 like shape with the base 4 and the extension 5. The outer layer 3*a* resists abrasion and puncture encountered in daily wear of a boot 1. In the preferred embodiment, an intermediate layer 3*b* is inward and adjacent to the outer layer 3*a* on the inside of the boot 1. The intermediate layer 3*b* serves as an insulator for the boot 1 and the liquid medicine. Also, the intermediate layer 3*b* functions as a secondary container for the liquid medicine. Inward and adjacent to the intermediate layer 3*b*, the inner layer 3*c* abuts the sole 2, extends upwardly and contains a foot. Proximate to the surface of a foot, the inner layer 3*c* contains water or another liquid in which a medicine dissolves. The dissolved medicine then treats the foot condition while a person wears the boot 1 for applying medicines.

Figure 4:
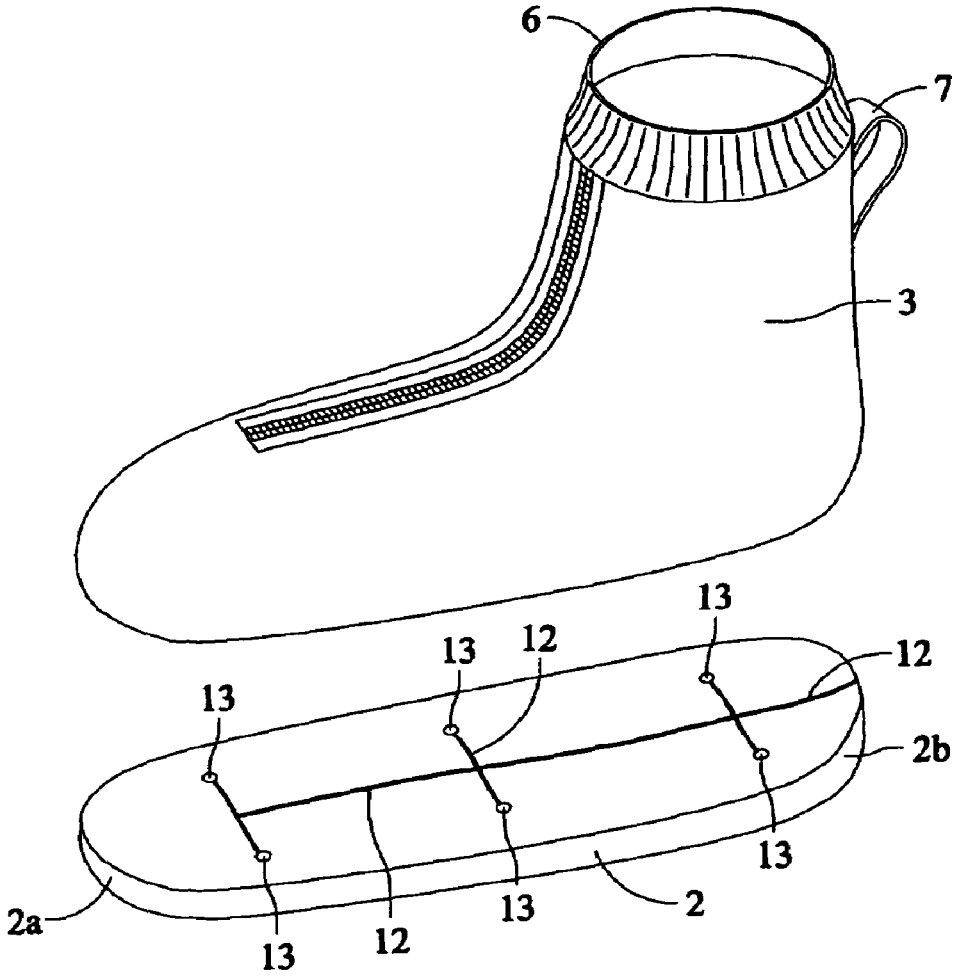
FIG. 4 shows an exploded view of the preferred embodiment of the present invention with a heating system; and, FIG. 5 describes an alternate embodiment of the present invention with a removable insert.

FIG. 4 shows the heating system 8 that improves the comfort for a foot immersed in a liquid. Heating the liquid limits sensation of cold that deters a person from wearing the boot 1. As the heated liquid allows longer wear of the boot 1 and the medicinal fluid, a foot has greater opportunity to heal. FIG. 4 has the heating system 8 contained within the sole 2. Direct current travels from the battery box 10, through the switch, down the wiring 12 along the heel 2*b*, and into the sole 2. The wiring 12, embedded in the sole 2, extends down the length of the sole 2, generally in the middle. Branches extend from the central wiring 12 and end in heating elements 13, disks 13, or the like. In the preferred embodiment, the disks 13 have three pairs regularly spaced along the sole 2. The disks 13 supply conductive heat from the sole 2 to the upper 3. The spacing corresponds to the heel area, the arch, and the ball area of a foot. When wired in parallel, the disks 13 still heat though one or more disks 13 may fail. Should the foot feel cold, a person checks the battery 9 and replaces it if needed.

Figure 5:
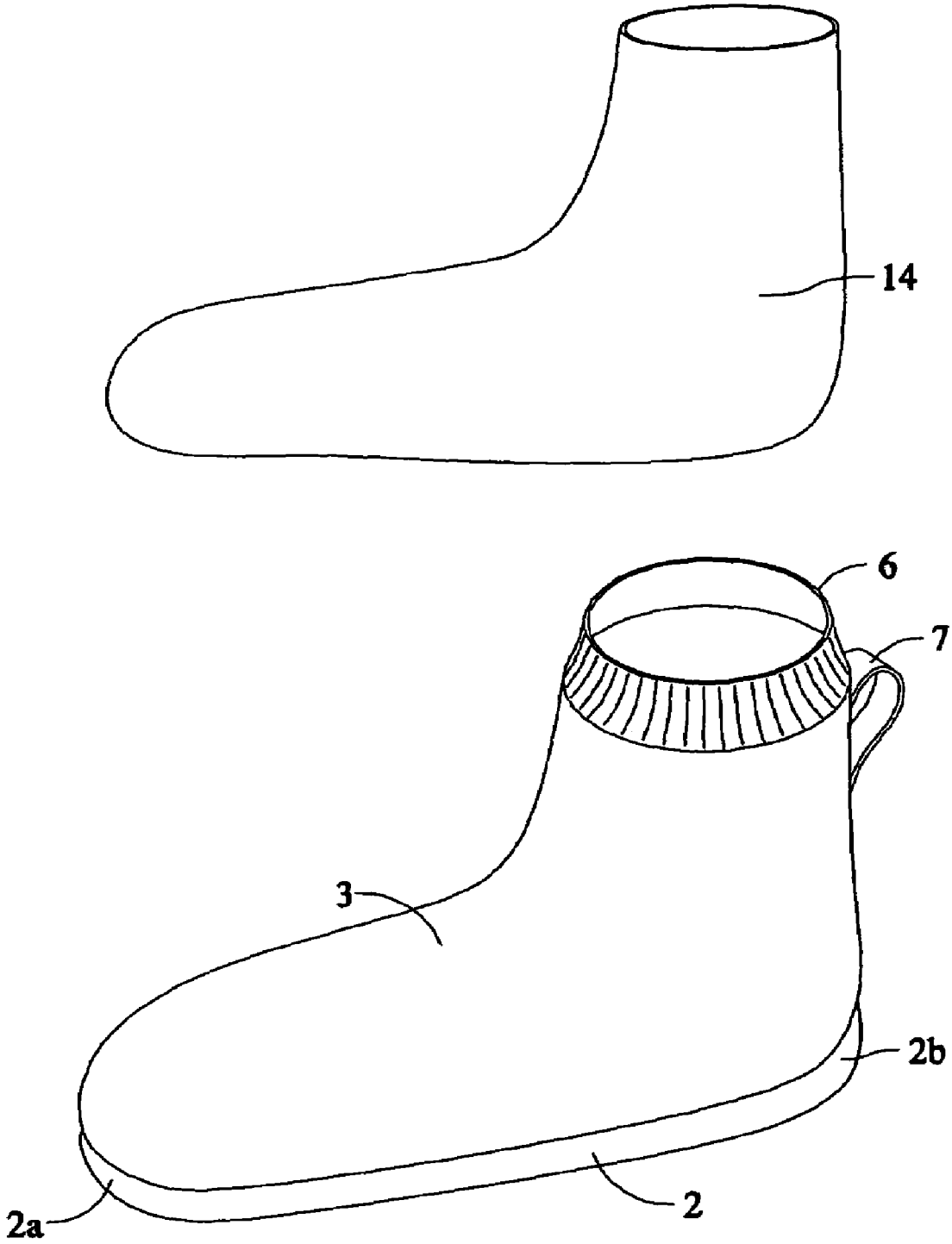

Alternatively, the present invention 1 has an insert 14 placed within a boot 1 in FIG. 5. The boot 1 has a sole 2 and an upper 3 attached to the sole 2 along with the heating system 8 as before. The upper 3 has one or more layers, not necessarily waterproof as in the preferred embodiment. The upper 3 has a loop 7 towards the top and a cuff 6 to secure the upper 3 to the lower leg of a person. The alternate embodiment has an insert 14 of similar shape to the upper 3 that admits a foot. The insert 14 is waterproof and covers the sole 2, instep, ankle and lower leg of a person.

To utilize the boot 1 for applying medicines, a person places three to four ounces of fluid into the boot 1 and flips the switch 11 to heat the sole 2 and the upper 3. After waiting briefly, a person places a foot through the cuff 6 and into the boot 1. If needed, a person places additional fluid into the boot 1. A person then adds medicine to the liquid through the cuff 6. A person then wears the boot 1 through daily activities at home and at work. If the boot 1 and liquid become too warm, a person flips the switch 11 to off. When a day's treatment of the foot ends, a person switches the heating to off and removes the foot from the boot 1 for drying. A person then dumps the fluid from the boot 1 and swabs the boot 1 clean. The boot 1 now awaits fluid and medicine for the next treatment.

To use the alternate embodiment, a person places fluid into the insert 14 and then his foot into the insert 14. The person adds medicine and additional fluid as needed to the insert 14. Then the person places the insert 14 surrounding his foot into the boot 1. If the fluid and foot become cold, a person flips the switch 11 to activate the heating system 8. A person then wears the boot 1 through daily activities at work and at home. If the boot 1 and liquid become to warm, a person flips the switch 11 to off. When a day's treatment of the foot ends, a person switches the heating to off and removes the insert 14 from the boot 1 and his foot from the insert 14. A person then dumps the fluid from the insert 14, washes the insert 14 and his foot, and swabs the boot 1 clean if needed. The insert 14 now awaits fluid and medicine before placing into the boot 1 for the next treatment.

The preferred embodiment uses a plastic inner layer, a non-woven intermediate layer, and a leather outer layer for the upper. The sole is a durable material molded to accept the heating disks and wiring within the sole. The insert is a flexible and waterproof material suitable for skin contact. From the aforementioned description, a boot for applying medicine has been described. The boot for applying medicine is uniquely capable of containing and heating a medicine dissolved in a liquid around a foot. The boot for applying medicine may be manufactured from many materials including, but not limited to, leathers, vinyl, plastics, ferrous and non-ferrous metal foils and their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

Having generally described this invention, a further understanding can be obtained by reference to certain specific examples which are provided herein for purposes of illustration only and are not intended to be limiting.

We claim:

1. Footwear for applying medicine to a foot of a person within said footwear comprising:

a sole;

an upper, having the general shape of a boot, a base generally to contain the heel, the instep and the ball of a foot, said base joined to said sole, and an extension generally to contain the ankle and a portion of the lower leg of a person, said extension made with said base, and a cuff upon said extension opposite said sole;

said upper having an outer layer, one or more intermediate layers inside of said outer layer, and an inner layer inside of said intermediate layers and said inner layer being waterproof;

a means to pull said extension generally located above said heel proximate said cuff; and, a heating system within said sole and controlled externally upon said extension;

whereby said heating system warms said sole, said base, and a foot placed within said footwear;

whereby said cuff contains liquids and medicines placed within said upper; and, whereby a person can wear said footwear during a day of activity while medicinal liquid bathes a foot for treatment.

2. The footwear of claim 1 further comprising:

said heating system having one or more batteries, a box for said batteries, a switch, and parallel wiring delivering power to one or more heating disks within said sole under the control of said switch, said disks having less than the thickness of said sole and being in contact with said base; and, said battery box and said switch are located upon said extension proximate to said cuff, generally above the ankle of the wearer of said footwear.

3. Footwear for applying medicine to a foot within said footwear comprising:

a sole;

an upper, having the general shape of a boot and joining said sole, and a cuff upon said upper opposite said sole;

an insert sized to accept a foot and part of a leg, said insert fitting within said upper; and, a heating system within said sole and controlled externally upon said upper;

whereby said heating system warms said sole, said base, and a foot placed within said insert;

whereby said cuff contains liquids and medicines placed within said insert; and, whereby a person can wear said footwear during a day of activity while medicinal liquid bathes a foot for treatment.

4. The footwear of claim 3 further comprising:

said heating system having one or more batteries, a box containing said batteries, a switch, and parallel wiring delivering power to one or more heating disks within said sole, said heating disks being less than the thickness of said sole and in contact with said upper and under the control of said switch; and said battery box and said switch are located upon said upper proximate to said cuff above the ankle of the wearer of said footwear.

* * * * *